US006453519B1

(12) United States Patent
Gelardi

(10) Patent No.: US 6,453,519 B1
(45) Date of Patent: Sep. 24, 2002

(54) BUCKLE

(75) Inventor: John A. Gelardi, Kennebunkport, ME (US)

(73) Assignee: Sagoma Plastics Corporation, Biddeford, ME (US)

( * ) Notice: Subject to any disclaimer, the term of this patent is extended or adjusted under 35 U.S.C. 154(b) by 17 days.

(21) Appl. No.: 09/634,464

(22) Filed: Aug. 7, 2000

Related U.S. Application Data

(60) Provisional application No. 60/147,399, filed on Aug. 6, 1999.

(51) Int. Cl.[7] ..... A44B 11/06; A44B 21/00

(52) U.S. Cl. ..... 24/163 R; 24/16 PB; 24/186; 24/265 BC; 24/543

(58) Field of Search ..... 24/163 R, 16 R, 24/16 PB, 499; 2/321, 333

(56) References Cited

U.S. PATENT DOCUMENTS

| | | | |
|---|---|---|---|
| 2,499,898 | A | 3/1950 | Anderson |
| 2,860,393 | A | 11/1958 | Brock |
| 3,203,067 | A | 8/1965 | Elsner |
| 3,905,071 | A | 9/1975 | Brumlik |
| 4,604,772 | A | 8/1986 | Arff |
| 4,918,790 | A | 4/1990 | Cirket et al. |
| 4,959,891 | A | 10/1990 | Chou |
| 5,212,838 | A | 5/1993 | Davidson et al. |
| 5,377,387 | A | 1/1995 | Freed |
| 5,414,904 | A | 5/1995 | Sampson |
| 5,479,797 | A | 1/1996 | Peterson |
| 5,548,878 | A | 8/1996 | Romagnoli |
| 5,615,455 | A | 4/1997 | Sorensen et al. |
| 5,634,245 | A | 6/1997 | Rouser et al. |
| 5,687,456 | A | 11/1997 | Chang |
| 5,715,580 | A | 2/1998 | Johnson, III |
| 5,745,957 | A | 5/1998 | Khokhar et al. |
| 5,758,443 | A | 6/1998 | Pedrazzini |
| 5,785,011 | A | 7/1998 | Gitterman, III |
| 5,815,891 | A | 10/1998 | Students et al. |
| 5,826,308 | A | 10/1998 | Chang |
| 5,848,454 | A | 12/1998 | Kojima |
| 5,875,522 | A | 3/1999 | Latal et al. |
| 5,918,387 | A | 7/1999 | Emerson |
| 5,920,965 | A | 7/1999 | Kleban |

*Primary Examiner*—Victor Sakran
(74) *Attorney, Agent, or Firm*—James Creighton Wray; Meera P. Narasimhan

(57) ABSTRACT

The new buckle is made of two pieces which work with laminated strap webbing or open weave strap webbing. Web engagements within the buckle prevent the web from sliding through in any direction, or allow the belting to move in only one direction. Bases of side extensions of the inner plate have locking lugs. Moveable rounded side portions of the outer plate have locking tabs which engage the lugs to prevent movement out or into the locking position. Locking and unlocking the buckle requires squeezing rounded sides together while pushing or pulling on the outer plate. Teeth extend inward from the outer locking plate. Angled through-holes in the lower plate receive the teeth and hold the locking teeth in engaged position when the buckle is locked. Locking teeth angularly mounted in recesses in the upper plate are deflected when the webbing strap is pulled in a tightening direction. The teeth in cooperation with the holes in the bottom plate prevent reverse movement of the webbing strap when the buckle parts are locked together.

23 Claims, 19 Drawing Sheets

BUCKLE

This application claims the benefit of U.S. Provisional Application No. 60/147,399, filed Aug. 6, 1999.

BACKGROUND OF THE INVENTION

Web strapping is widely used to tie down and secure cargo and loads. Web strapping is also used to secure attachments to bases and to secure occupants in place. Webbing straps are also used as belts for clothing.

Needs exists for better, less expensive and easier to make and use buckles which rapidly and securely grip and hold the web strapping, which permit tightening of the web strapping while in the engaged position, and which rapidly and easily release the web strapping when disengaged.

SUMMARY OF THE INVENTION

The buckle of the present invention provides for the needs of the prior art. The new buckle is made of two pieces which preferably are injection molded. The buckles may be made in different sizes and may be used in multiple applications. The buckles work with laminated strap webbing or open weave strap webbing. The buckles allow the webbing to pass through the buckle and allow the users to engage or disengage the locking. The web engagements within the buckle can prevent the web from sliding through in any direction, or can be configured to allow the belting to move in only one direction.

The buckle parts are moldable in multiple materials and are low in cost.

The outer buckle plate is elongated in the strap direction. The flat top of the plate has extensions which extend over the webbing to maintain the flatness of the webbing within the buckle. Two curvilinear cutouts at opposite sides of the flat plate allow flexing, springing or bridging of the major side portions of the upper buckle member. Thin upper edge portions act as springs. Curved inward extending tops rigidify the rounded sides which are pressed inward to relatively move the two-buckle parts into engaged or disengaged position.

Four guide legs extend downward from the flat top near the corners to slide within alignment openings in the sides of the inner plate. Inward extending keeper tabs at lower ends of the legs ride over and engage ledges within the guide openings to snap the members together and to prevent separation of the buckle members once the buckle members have been snapped together.

Alignment projections on the sides of the inner buckle member fit within openings in the sides of the outer buckle member. Opposite central side recesses in the inner member or base plate receive and allow inward movement of the major side portions of the outer member. Curved lateral outer edges of the inner plate prevent overtravel of the movable side portions.

Bases of the side extensions of the inner plate have locking lugs which extend toward the central opening. The movable rounded side portions of the outer plate have locking tabs which engage the lugs to prevent movement out of the locking position when the locking tabs are engaged with bottoms of the locking lugs, and which prevent movement into the locking position when the locking tabs are positioned above the tops of the locking lugs. Locking and unlocking the buckle requires squeezing rounded sides together while pushing or pulling on the outer plate. Alternatively, bottoms of the locking tabs are chamfered so that they automatically override the locking lugs when the two plates are pressed together to lock the buckle.

Teeth extend inward from the outer locking plate. Angled through-holes in the lower plate receive the teeth and hold the locking teeth in engaged position when the buckle is locked.

In one embodiment, the locking teeth are angularly mounted in recesses in the upper plate so that the teeth may be deflected when the webbing strap is pulled in a tightening direction, and so that the teeth in cooperation with the holes in the bottom plate prevent reverse movement of the webbing strap when the buckle parts are locked together.

The lower plate has at one end an extension with a transversely elongated opening for receiving a loop in a fixed end of the webbing strap. The loop is stitched, bonded, welded or interwoven to the strap near its fixed end. The loop-receiving end of the inner plate also has an upper rectangular guide which passes the free end of the webbing strap out of the buckle. The opposite end of the inner plate has a rectangular guide extending from the plate for guiding the free end of the webbing strap as it enters the buckle.

The present invention provides a low cost, readily assemblable and easily usable buckle to selectively permit and prevent webbing straps from sliding through the buckle.

These and further and other objects and features of the invention are apparent in the disclosure, which includes the above and ongoing written specification, with the drawings.

DETAILED DESCRIPTION OF THE PREFERRED EMBODIMENTS

Figure 1:
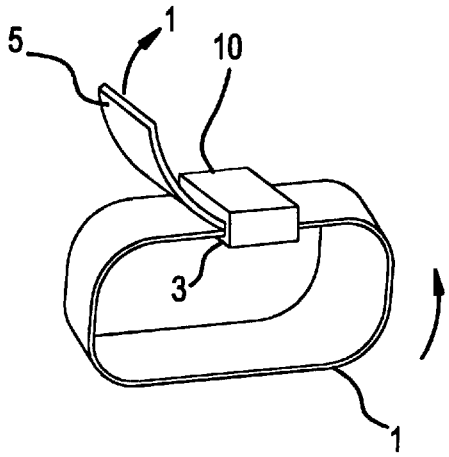
FIG. 1 shows a webbing strap with a locking buckle of the present invention.

As shown in FIG. 1, a webbing strap 1 has a fixed end 3 and a free end 5. The free end extends through a locking buckle 10 and is tightened by pulling in the direction shown by arrow 7.

Figure 2:
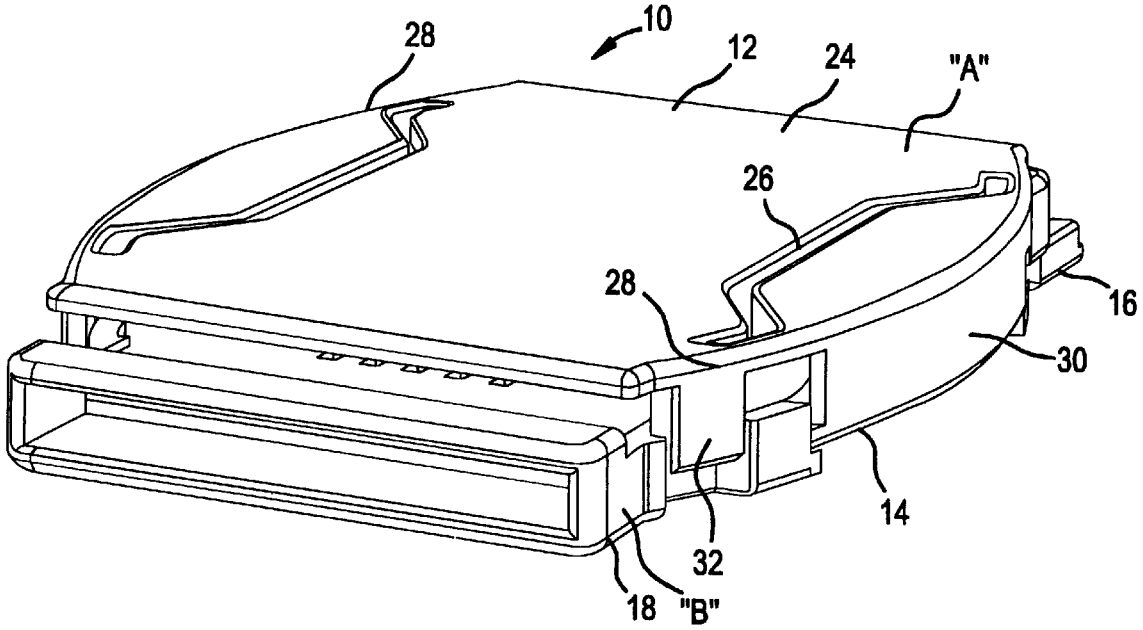
FIG. 2 is a perspective view of the two-part two-position locking buckle.

In FIG. 2 the locking buckle 10 has an outer buckle plate 12, which may also be called a top or cover, and an inner buckle plate 14, which may be also called a base. The base 14 has a mounting extension 16 with a transverse elongated opening for receiving a loop and mounting the fixed end 3 of the webbing strap. A guide 18 uniformly extends from the base 14 for receiving and guiding the free end 5 of the webbing strap.

Figure 3:
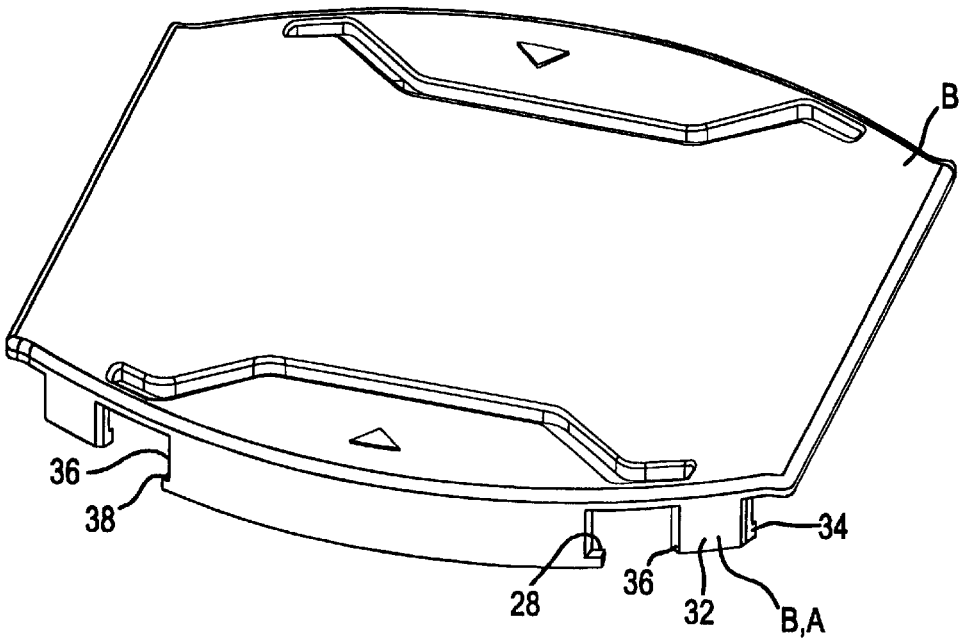
FIG. 3 is a perspective view of the outer buckle plate or top cover part of the two-part buckle.
Figure 4:
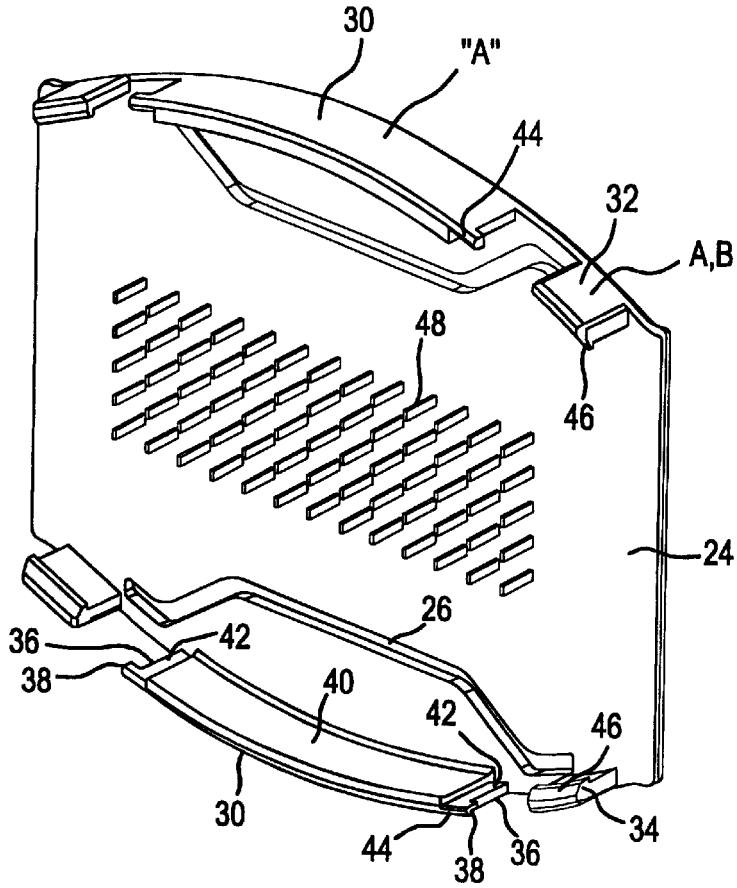
FIG. 4 is a perspective view showing a bottom view of the top cover part.
Figure 5:
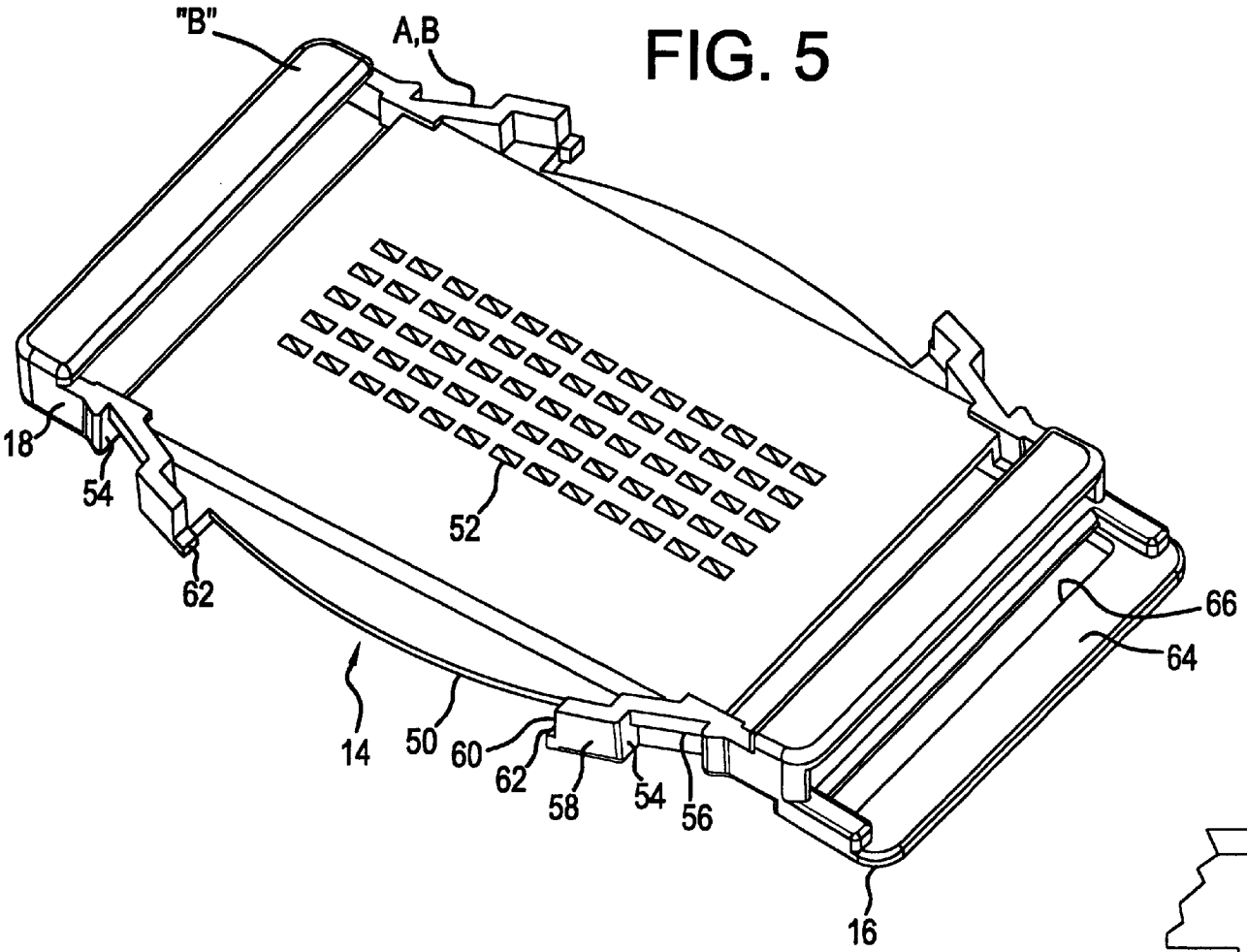
FIG. 5 is a top perspective view of the inner buckle plate or buckle base, which is the second part of the buckle.
Figure 6:
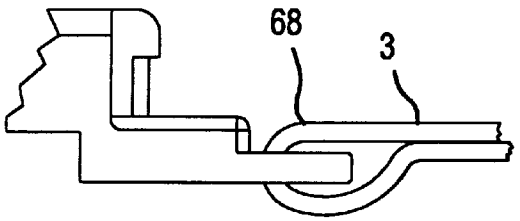
FIG. 6 is a detail of connection of a fixed end of the webbing strap to the buckle base.
Figure 7:
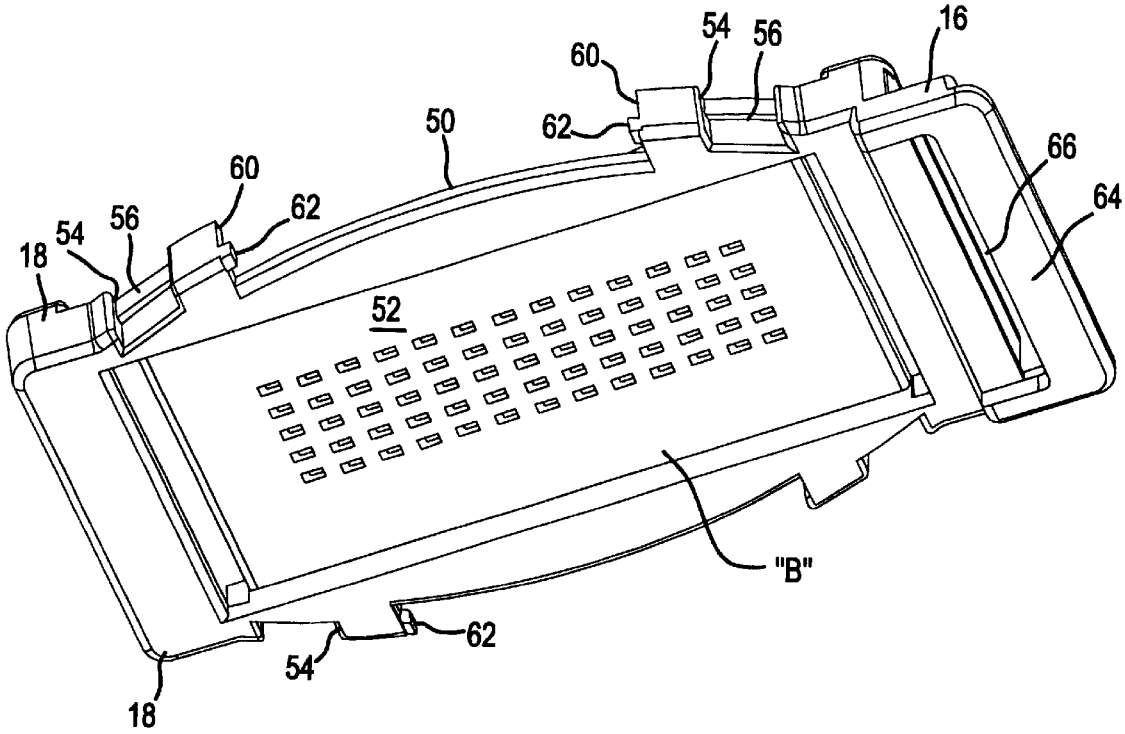
FIG. 7 is a bottom perspective view of the base.

As shown in FIGS. 2–4, the outer buckle plate 12 or cover has a flat upper portion 24 with cutout areas 26 and spring areas 28, which allow inward movement of the major curved side portions 30. The flat curved edge portion retains rigidity of the side portion 30. The outer buckle plate 12 also has downward extensions 32 with inward extending retaining tabs 34, which cooperate with ledges on the inner plate to hold the two parts together. Large recesses 36 in the opposite sides of the outer buckle plate 12 have position locking tabs 38 extending into the recesses for cooperating with lugs on the inner buckle plate to lock the two plates in web disengaging position or web engaging and holding position.

As shown in FIG. 4, inner edges of the openings 36 and the locking tabs 38 are recessed from the curved inner surface 40 of the movable sides 30. The recessing 42 allows for relative movement of the buckle numbers without disengaging. The bottom surfaces of the locking tabs are chamfered 44 to assist movement into the engaged or locking position. Inner edges 46 of the retaining tabs 34 are chamfered to aid in the overriding and snap fitting of the buckle parts during assembly.

Locking teeth 48 extend inward from the flat part 24 of the outer buckle plate 12 to engage openings in the webbing.

As shown in FIGS. 5–8, the inner buckle plate 14 or base has a curved outer edge 50 that limits inward deflection of the movable sides 30 of the upper buckle plate.

Angled through-holes 52 guide and position the locking teeth from the outer buckle plate when the two members are moved into and held in engaged position. A retaining area 54 receives the retaining extension 32, and the ledges 56 cooperate with retaining tabs 34 to limit the opening travel of the two parts once the parts have been snapped together.

Guides 58 have inner edges 60 which guide the end surfaces of the movable sides 30 of the upper plate 12. Inward extending position locking lugs 62 cooperate with the locking tabs 38 on the sides 30 of the outer buckle plate to hold the two plates in the locked position or to release the two plates for movement in the disengaged condition. As shown at the right hand side of FIG. 6, the inner buckle plate 14 has the strap-holding extension 16 with a shelf portion 64 and a transverse elongated opening 66, which receives the loop 68 on the fixed end 3 of the webbing strap. The opposite end 18 of the inner buckle plate 14 serves as a guide for the free end of the strap.

Figure 8:
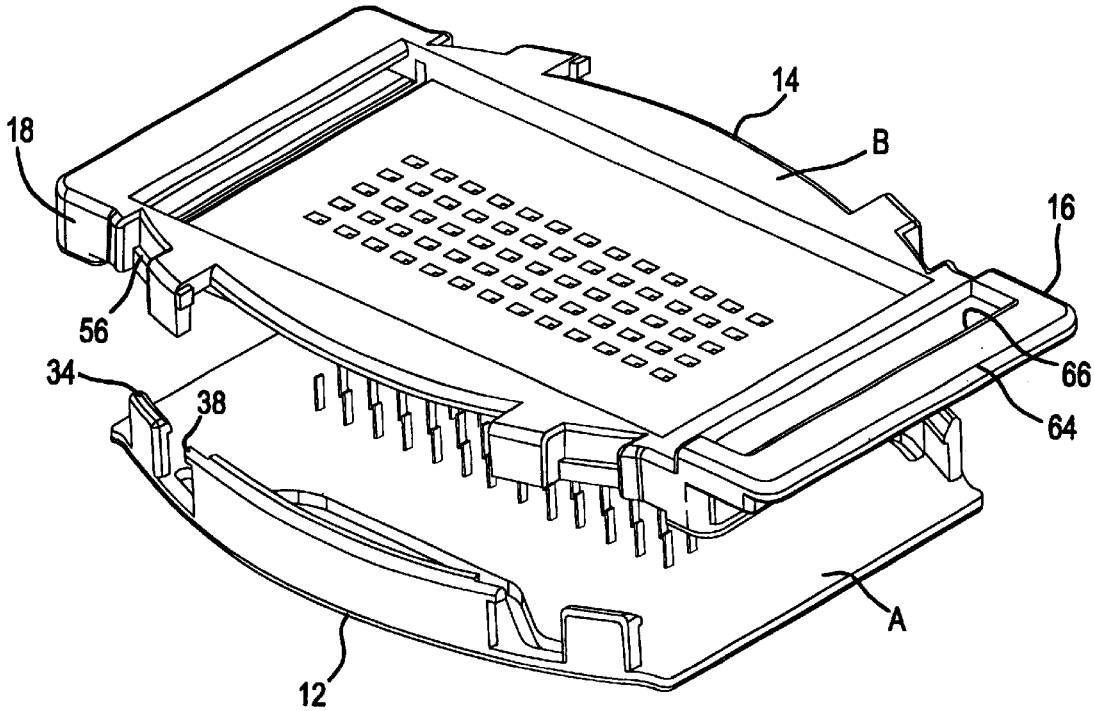
FIG. 8 is an inverted perspective view of the two parts of the buckle immediately prior to assembly.

As shown in the inverted view of FIG. 8, the two parts, the outer buckle plate 12 and the inner buckle plate 14 are aligned before being snapped together. The snapping together occurs by the tabs 34 overriding and then engaging the ledges 56. When snapped together the locking buckle is in the disengaged position. Engaging the locking buckle requires squeezing the opposite curved sides 30 inward and passing the locking tabs 38 inside of the locking lugs 62, while the buckle parts are pressed together. After sides 30 are released, the locking tabs 38 spring outward with the sides 30 to engage bottoms of the lugs 62.

Figure 9:
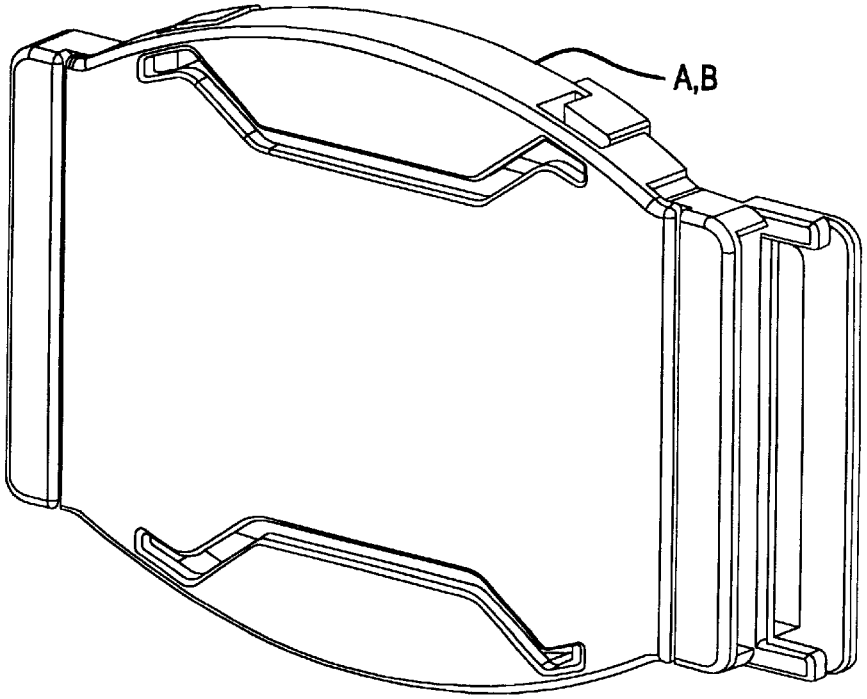
FIG. 9 is a perspective view of the assembled buckle parts showing the disengaged position.

FIG. 9 shows the outer buckle plate and inner buckle plate after they have been snapped together. The buckle plates are in the disengaged position.

Figure 10:
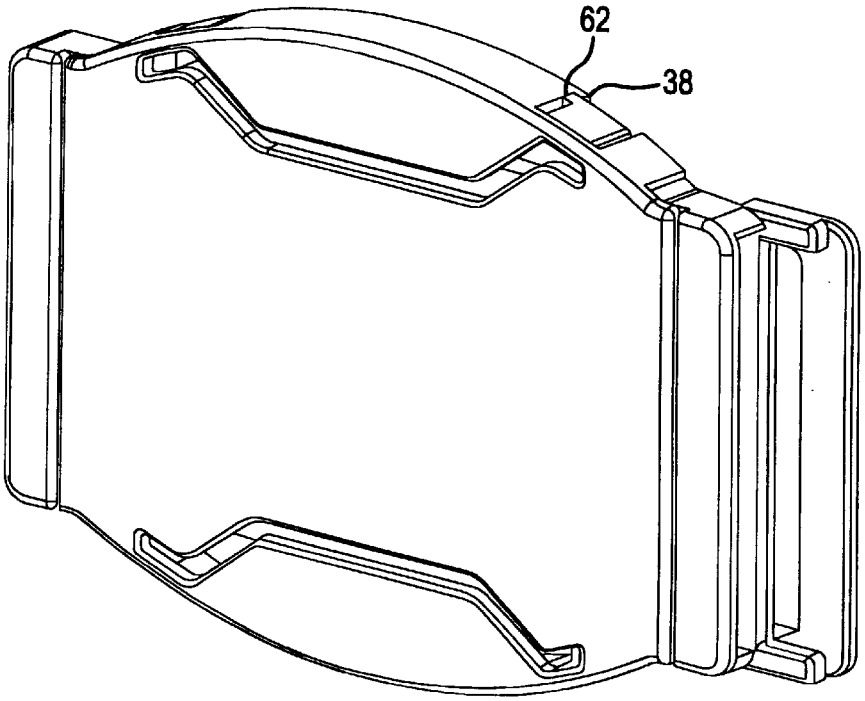
FIG. 10 is a view similar to FIG. 9 showing the engaged locking position of the buckle.

FIG. 10 shows the outer buckle plate and inner buckle plate in the engaged position, with the locking tabs 38 held by the locking tabs 62.

Figure 11:
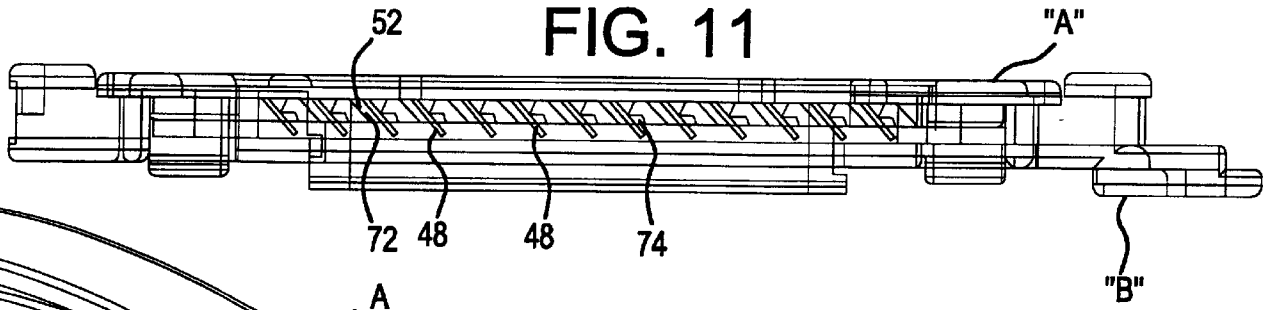
FIG. 11 is a cross-sectional view of the buckle showing the locking position.

FIG. 11 shows the angled through holes 52 for receiving the teeth 48 after they have extended through the webbing, and holding the teeth in locked position. The angled through locking holes 52 have a sloped surface 72 and an angular opposite surface 74, which capture the teeth 48 and prevent their being withdrawn through the webbing.

Figure 12:
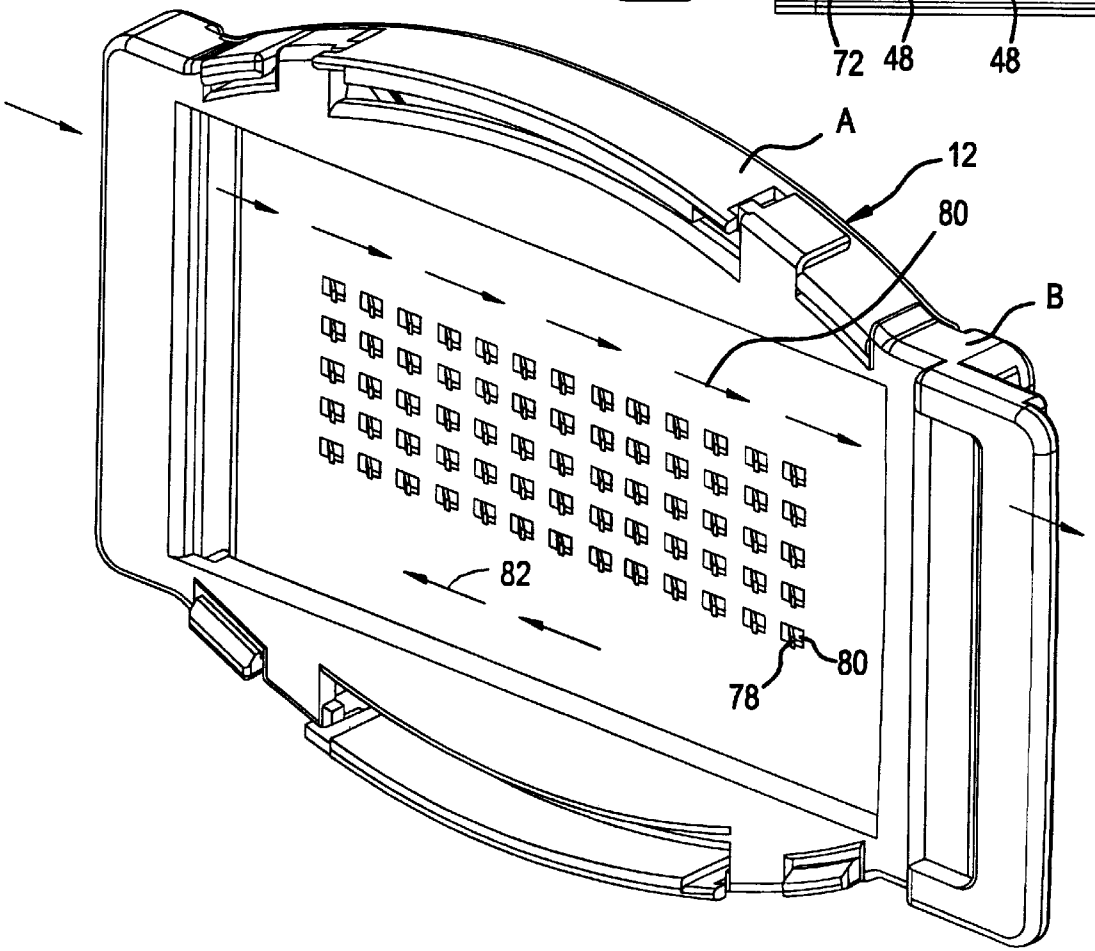
FIG. 12 is a bottom view of the upper buckle cover showing the one way teeth in the engaged position.
Figure 13:
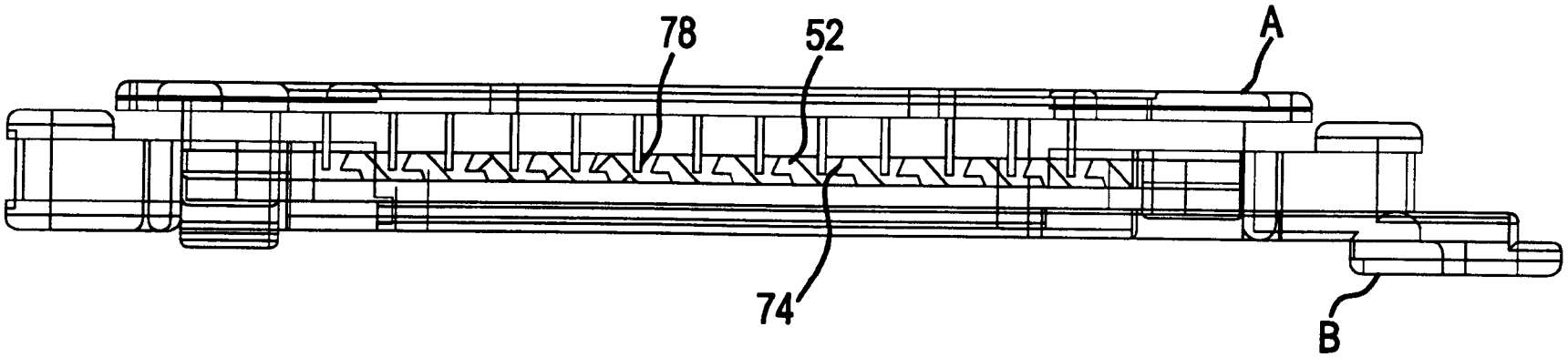
FIG. 13 is across-sectional view showing the locking teeth extending through the guide-deflecting holes.

In an embodiment of the invention shown in FIGS. 12 and 13, locking teeth 78 are mounted at angles within, openings 80 in the outer plate 12. The locking teeth 78 extend into the angled through-holes 52. The angled sides 74 of the through holes allow flexure and ratcheting movement of the teeth 78 and when the web is pulled in a tightening direction shown by the arrows 80 in FIG. 12, but prevent webbing movement in the reverse direction shown by arrows 82.

Figure 14:
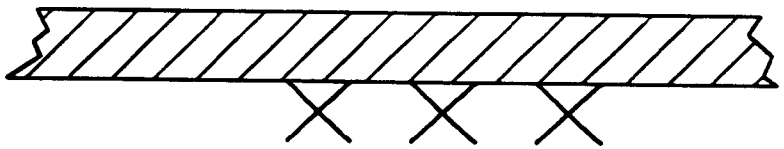
FIG. 14 is a schematic representation of locking teeth extending in opposite directions to prevent any movement of the web.

In another embodiment of the invention, the slopes of the teeth 78 alternate so that the teeth cross each other from a side view, as shown in FIG. 14, and prevent the webbing strap from moving through the buckle in either direction.

Figure 15A:
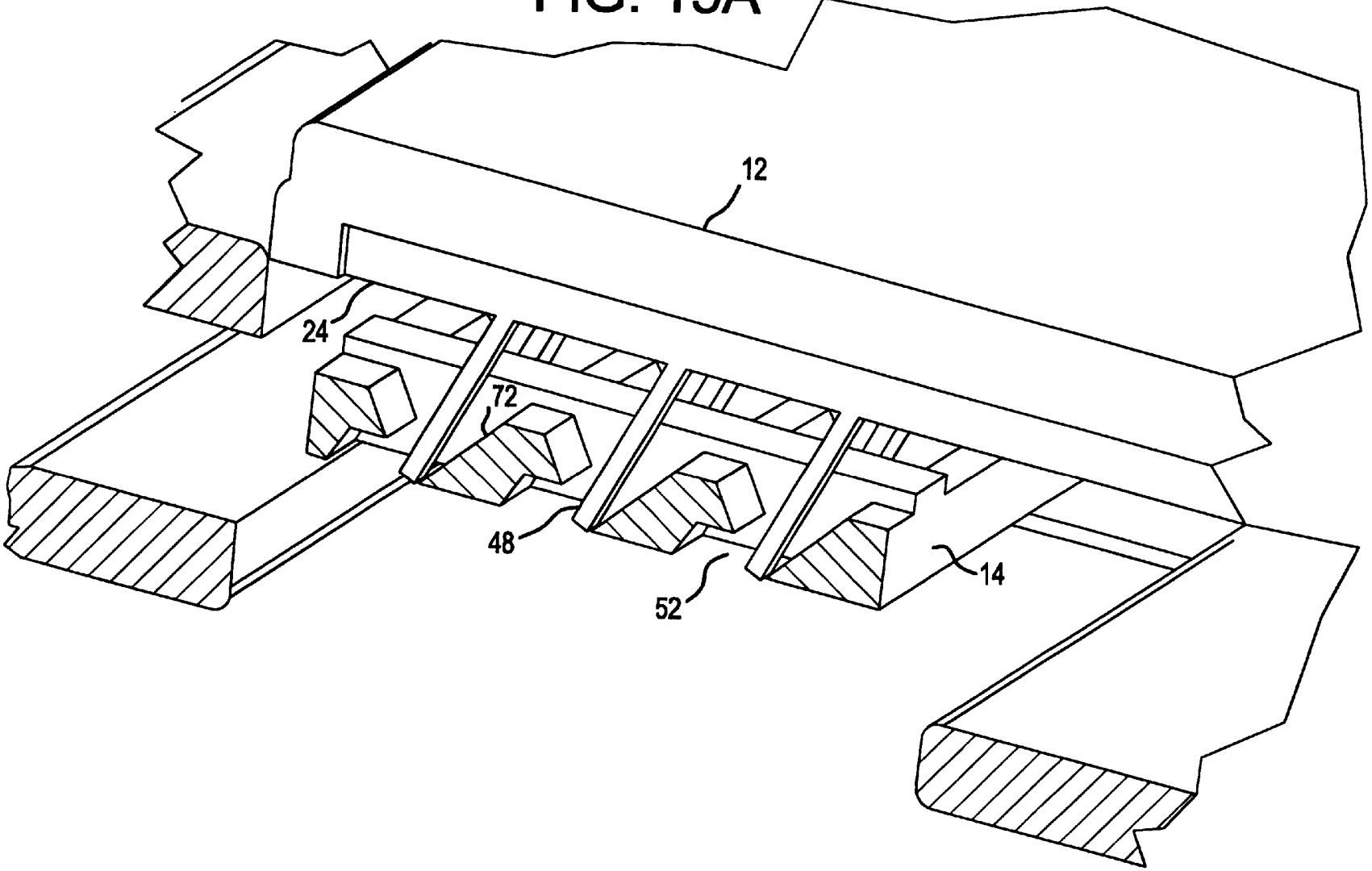
FIG. 15A is a cross-sectional detail showing the buckle teeth in an unlocked position.

FIG. 15A shows the locking prongs as they extend inward from the flat part 24 of the outer buckle plate 12 as they are angularly turned by the sloping surfaces 72 of the holes 52 in inner member 14.

Figure 15B:
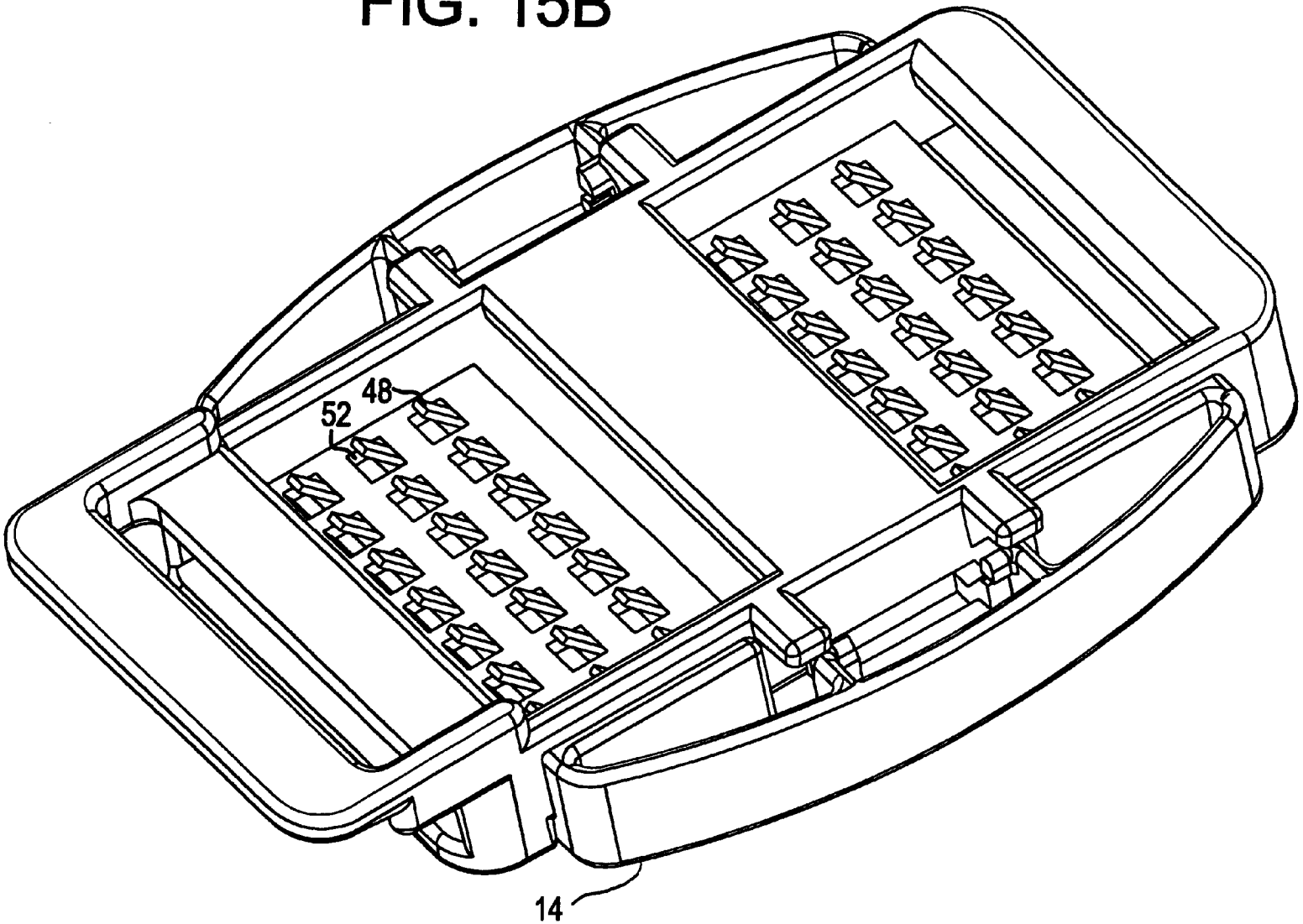
FIG. 15B is a perspective view of the two-part two-position locking buckle.

In FIG. 15A the outer member 12 is shown raised which withdraws the teeth 48 into the openings 52 and allows passage of the webbing through the buckle beneath the holes 52. In the bottom view shown in FIG. 15B, the web-locking prongs or teeth 48 are shown extended from the holes 52 in the inner member 14. That is the locking condition of the teeth, which engages openings in the webbing and prevents movement of the webbing at least in the reverse direction through the buckle.

Figure 15C:
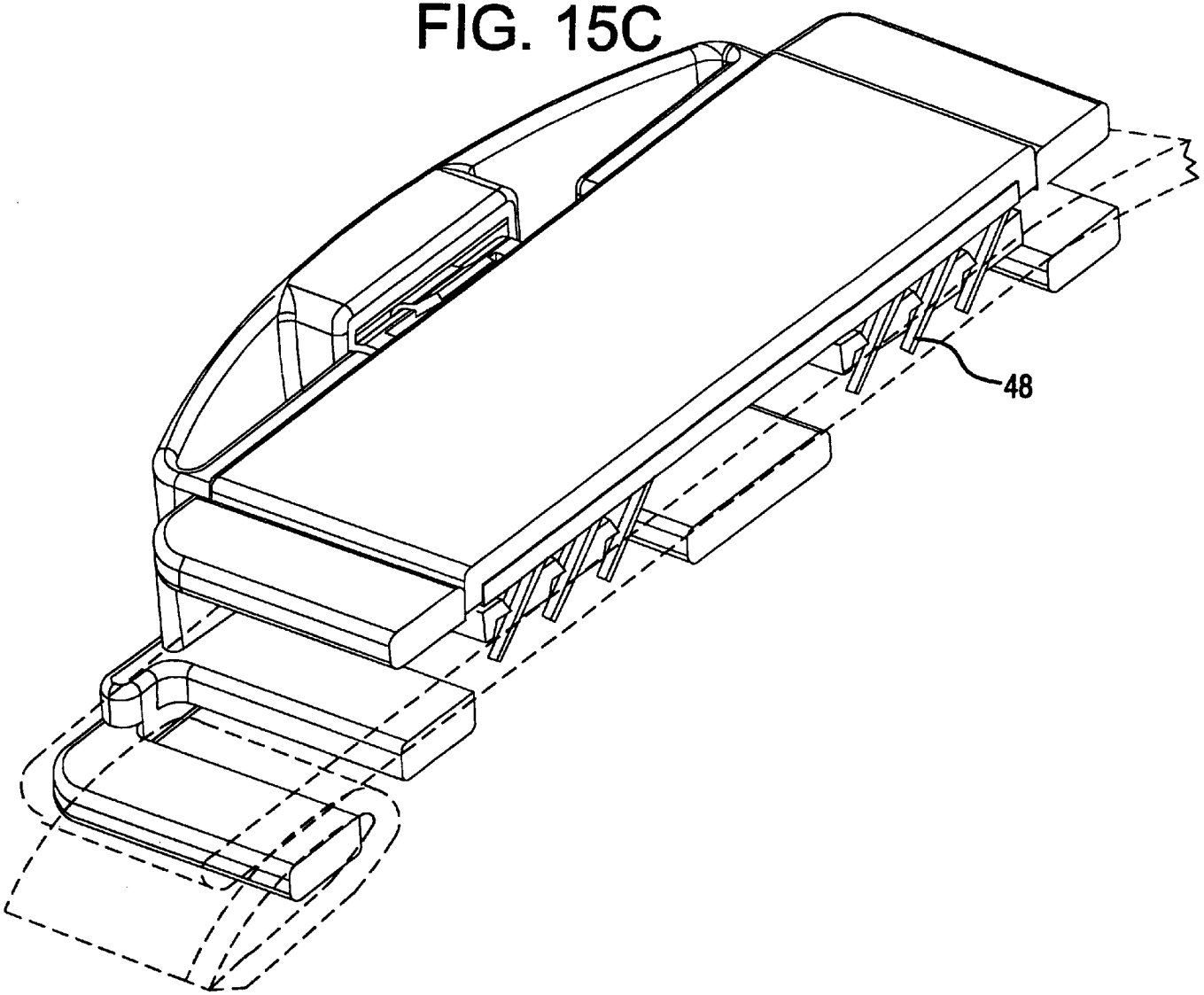
FIG. 15C is a cross-sectional view of the buckle showing the locking position with the locking teeth extending in opposite directions to prevent any movement of the web.

FIG. 15C is a cross-section of the buckle showing the prongs 48 extended through the openings in the inner plate to engage the webbing.

Figure 15D:
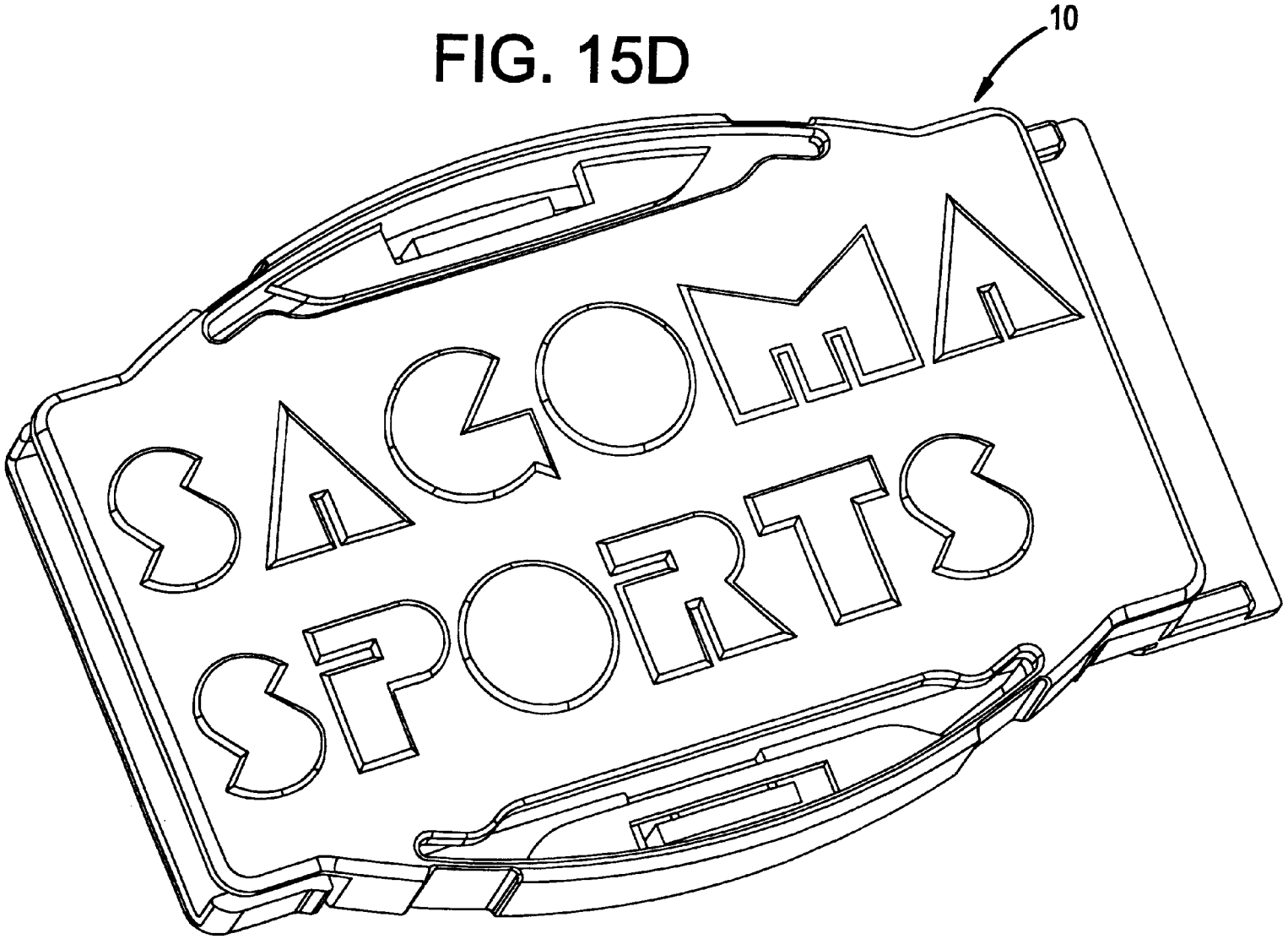
FIG. 15D is a perspective view of the outer buckle plate or top cover part of the two-part buckle.

FIG. 15D shows a prospective view of the buckle which can be used as an adjusting buckle for straps connected to sporting gear such as backpacks and equipment supporting belts for example.

Figure 16:
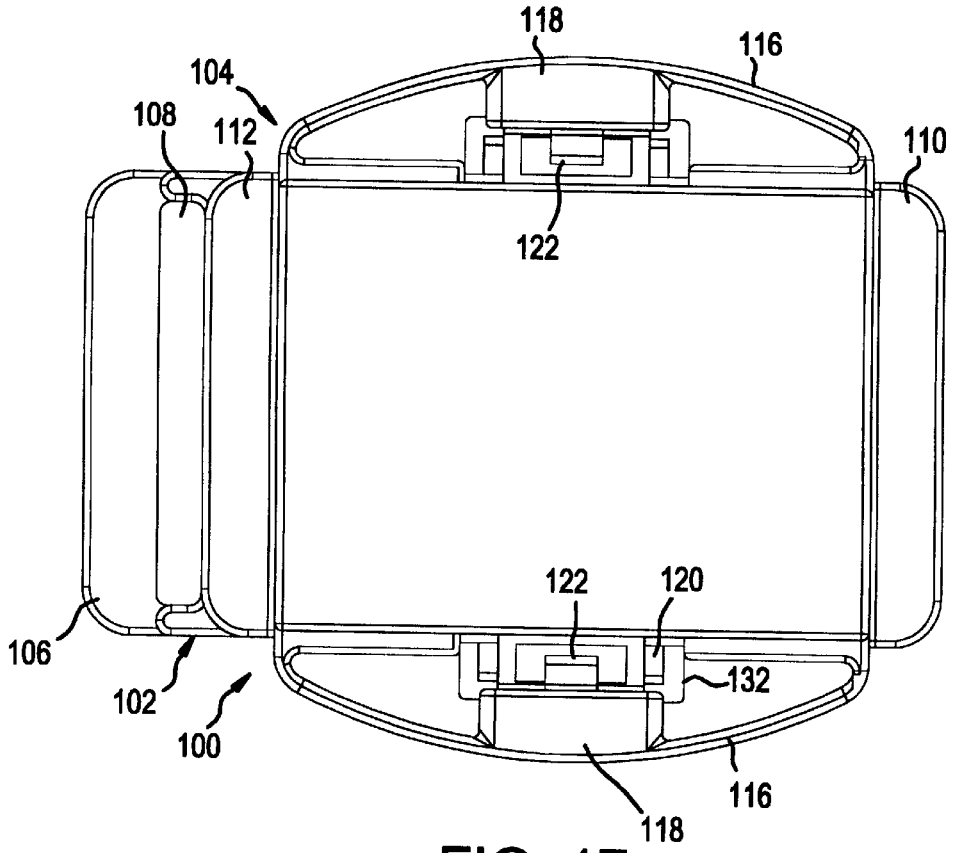
FIG. 16 is a plan view of the preferred buckle.

A preferred buckle is generally indicated by the numerals 100 in FIG. 16. The buckle 100 comprises an inner member 102 and an outer member 104. The inner member has a rim 106 around which one end of a webbing belt is secured. That end passes through opening 108. The free end of the webbing belt passes sequentially over shelf 110, under the inner and outer members 102 and 104 and over the shelf 112 near the belt and mounting ledge 106. The cover 104 has a flat outer face 114 and movable outer side elements 116, which are squeezed inward to change the state of the buckle. The central portions 118 are lifted upward by ramps 120 as the flexible sides 116 of the cover 104 are squeezed inward. Leaf springs 122 urge the outer member 104 to the upward, belt-releasing position.

Figure 17:
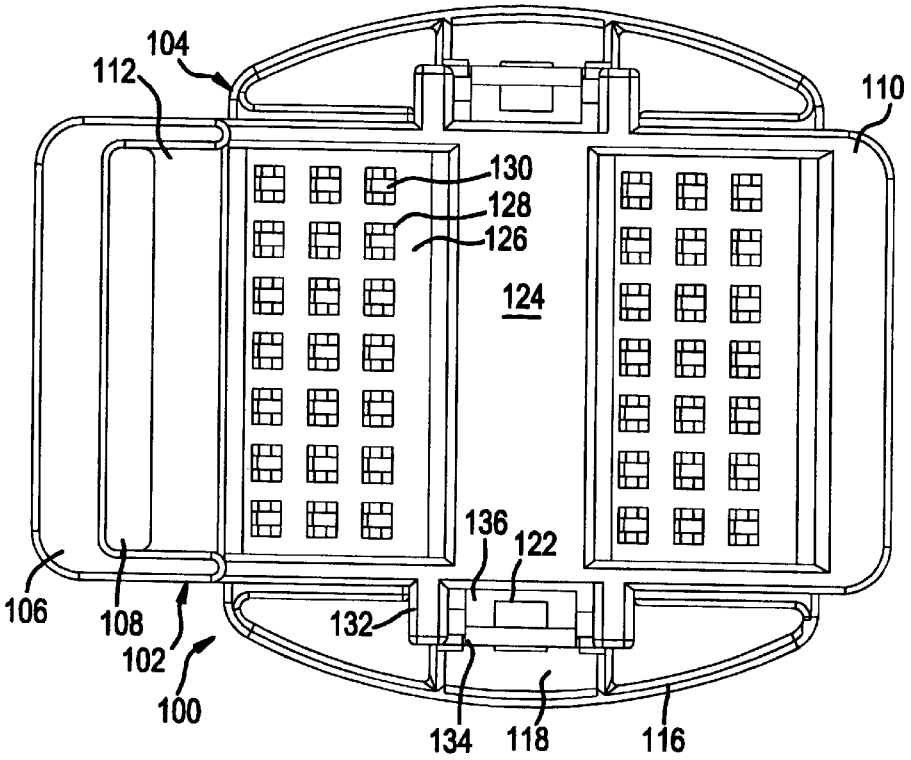
FIG. 17 is a bottom view of the buckle shown in FIG. 16.

FIG. 17 shows a bottom view of the assembled buckle. The bottom plate 102 has a flat central portion 124 on the opposite side of which the webbing belt passes as the free end passes successively over shelf 110, flat central portion 124 and shelf portion 112.

Central portion 126 of the inner member 102 has openings 128 with sloping surfaces which direct the locking tabs 130 into engagement with the webbing belt.

The projecting surfaces 132 of the inner buckle member 104 support the ramps 120 as shown in FIG. 16. A bridge 134 extends between the extensions 132 and supports the base of the cantilevered spring 122 so that it may pivot within the opening 136 when the flexible sides 116 are squeezed to move the latching members 118 inward.

Figure 18:
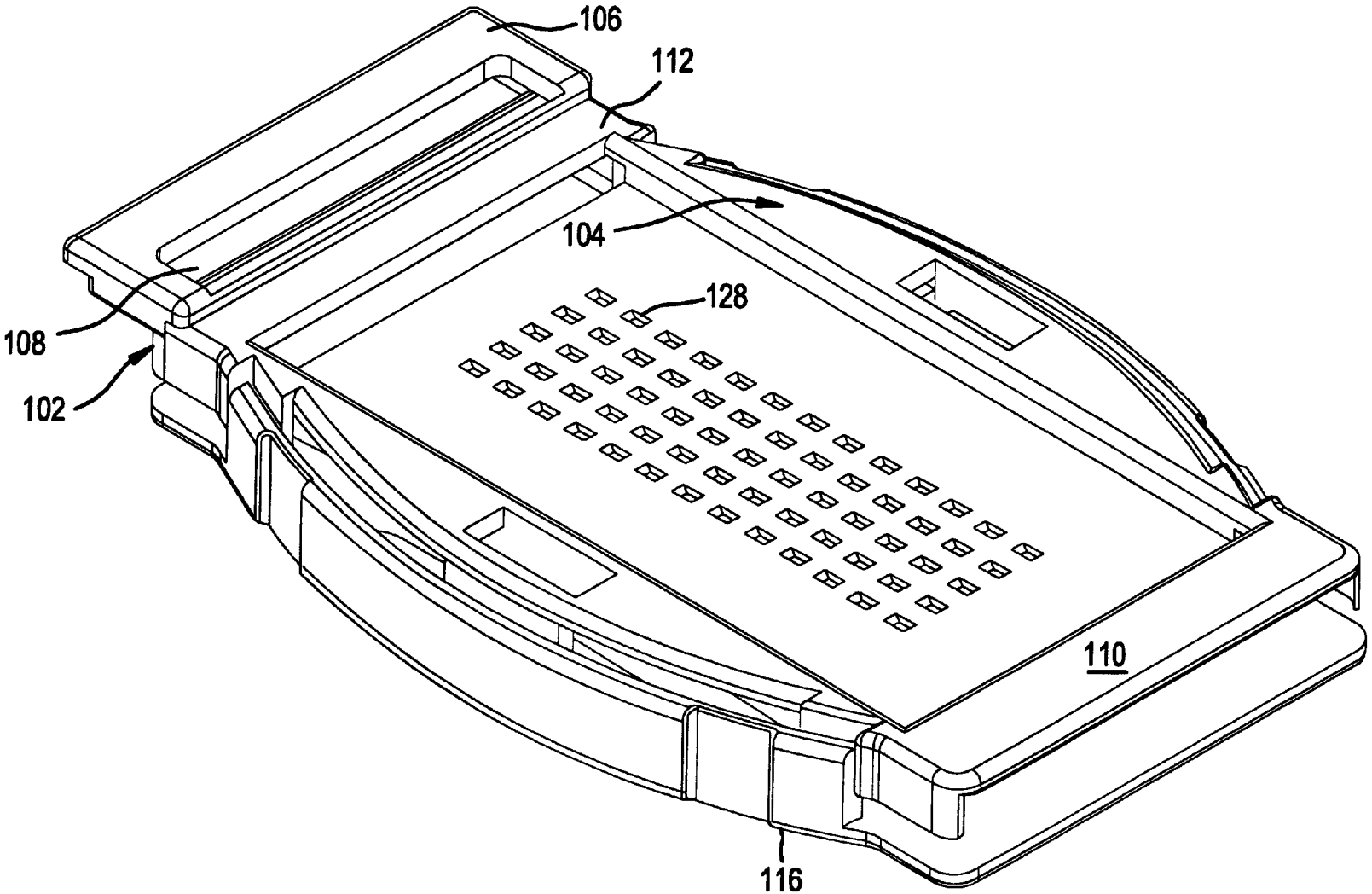
FIG. 18 is a prospective bottom view showing the buckle in the unlocked position.

FIG. 18 shows a perspective view from the bottom of the buckle in the unlocked, web-releasing position. The central member 124 of the base has been removed for clarity.

Figure 19:
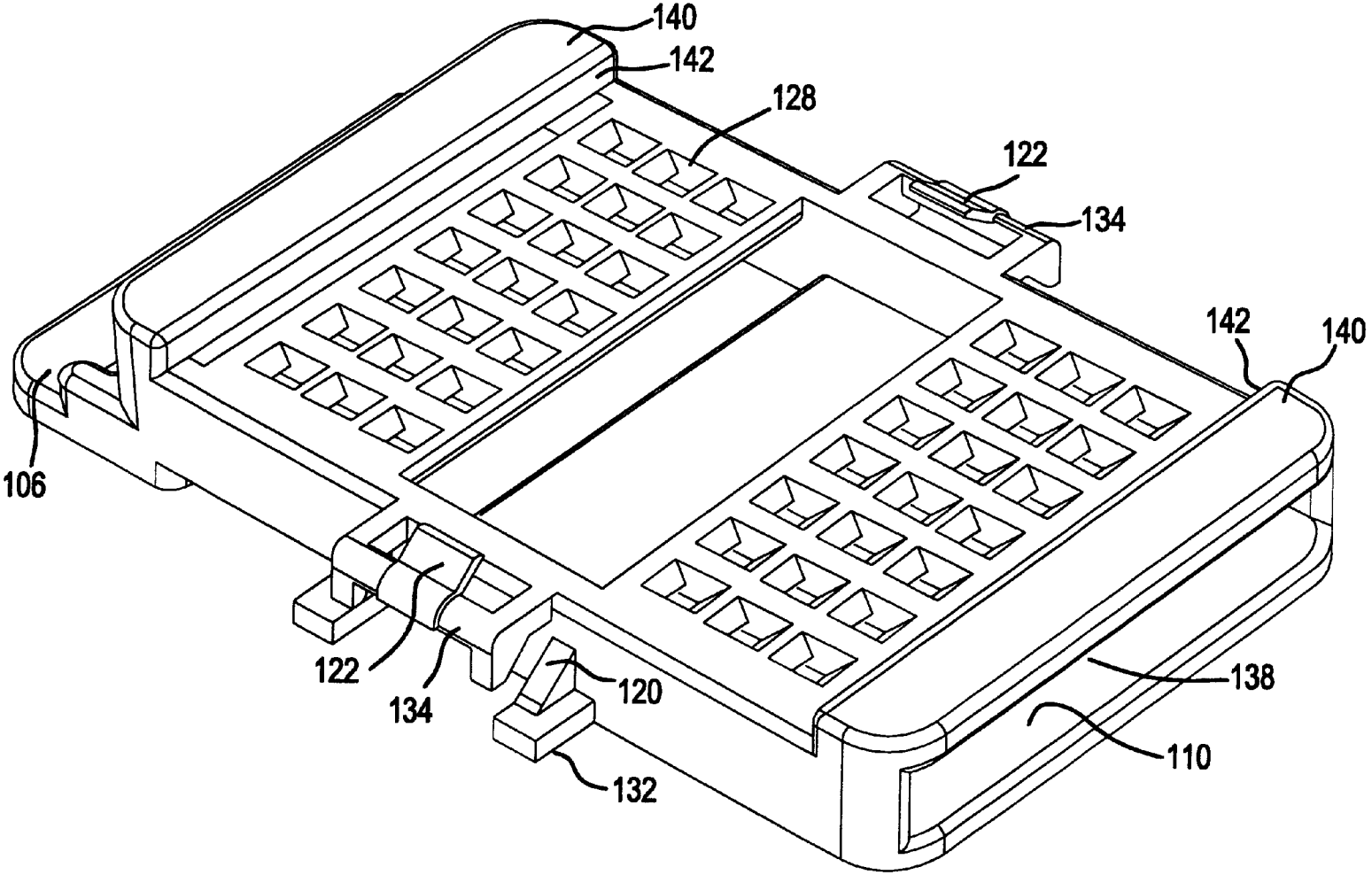
FIG. 19 is a prospective view of a preferred embodiment of the base showing the ramps and locks for holding the other cover in unlocked position.

FIG. 19 is a top view of the preferred buckle showing the opening 138 through which the free end of the webbing enters the buckle. Ends 140 of the buckle inner member are raised so that inner walls 142 guide the end edges 144 of the outer buckle member 104 as shown in FIGS. 16 and 20.

Figure 20:
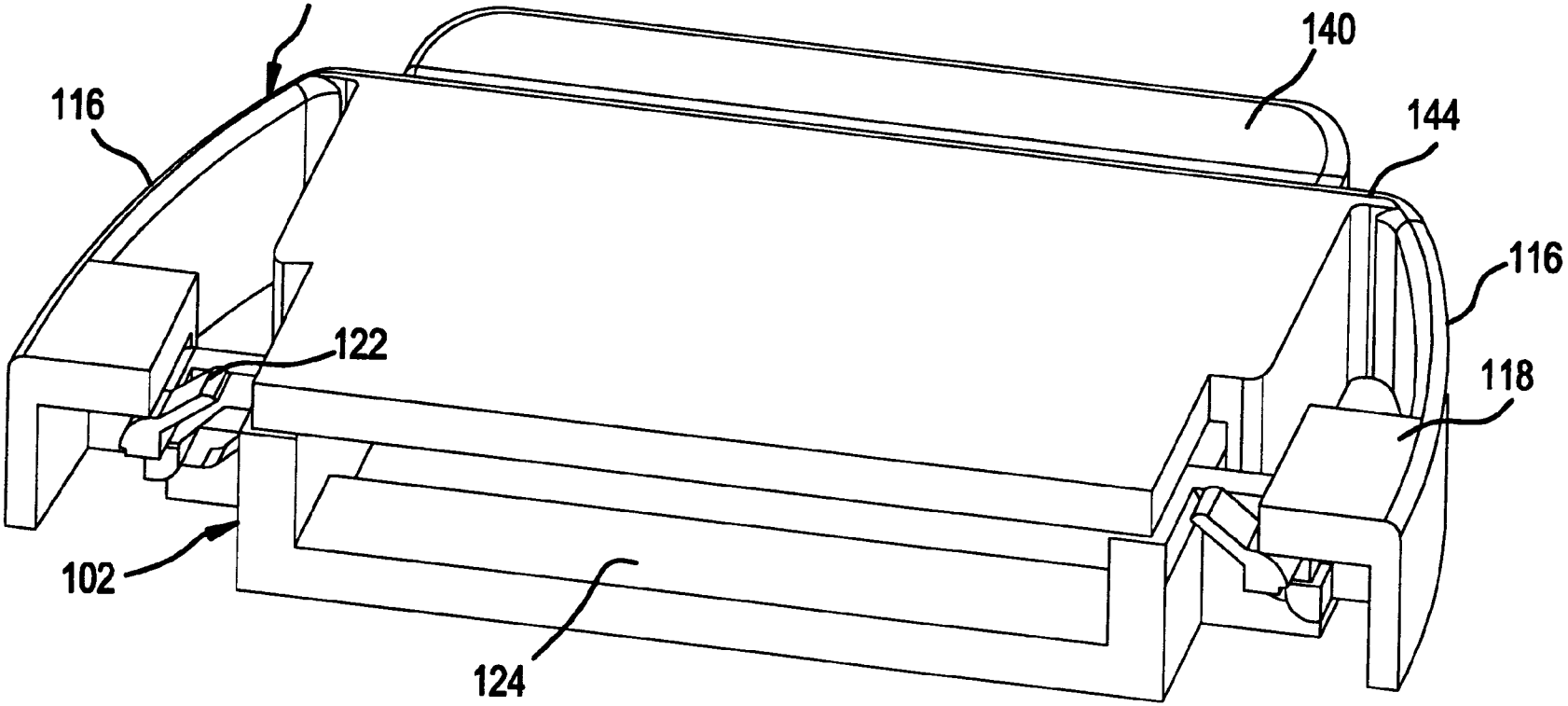
FIG. 20 is a cross-sectional prospective detail of the buckle taking along line 20 20 in FIG. 16 showing the buckle in web-gripping, locked condition.

FIG. 20 shows the flexible sides 116 and the springs 122 that urge the outer member upward after the sides have been squeezed inward and lifted by the associated ramps.

Figure 21:
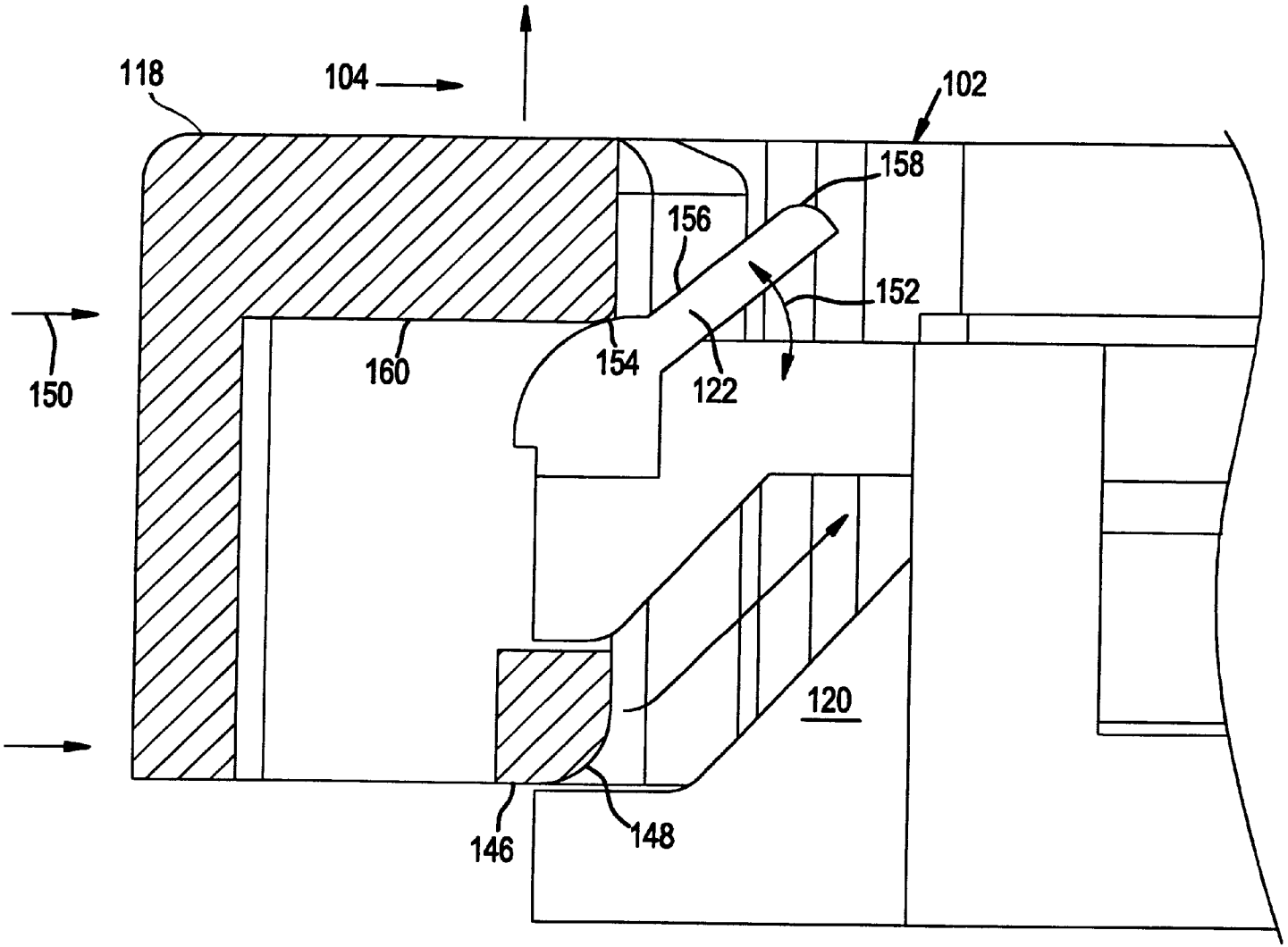
FIG. 21 is a detail of the buckle lock and: ramp showing the outer plate and inner buckle in closed, web-locking position.

FIG. 21 is a detail of the flexible latches 122 and the ramps 120 on the inner buckle member 102 and the collecting of portions of the outer buckle member 104.

Inward extending bars 146 with curved engaging portions 148 slide upward on ramps 120 as the central portion 118 of the outer member is squeezed inward in the direction of arrows 150. The latch 122, which flexes in the directions of the arrow 152, urges the central portion 118 upward as contact of the inner edge 154 moves along the sloped surface 156, and as the curved surface 158 contacts the inner surface 160 of the central member 118. The resilient members 122 tend to fold the cover plate 104 upward.

The latching member 122 may fit within a recess in the bottom of the central portion 118, holding the member 118 inward. Further inward movement on the members 118 lifts the members on the ramps 120 and disengages the latch, allowing the members 116 to spring outward so that the outer member may be pushed inward on the inner member into latching condition. The webbing strap pulling on the pins extending at an angle through the holes in the inner member tends to keep the buckle locked. Additional latches are provided between the inner and outer members.

Figure 22:
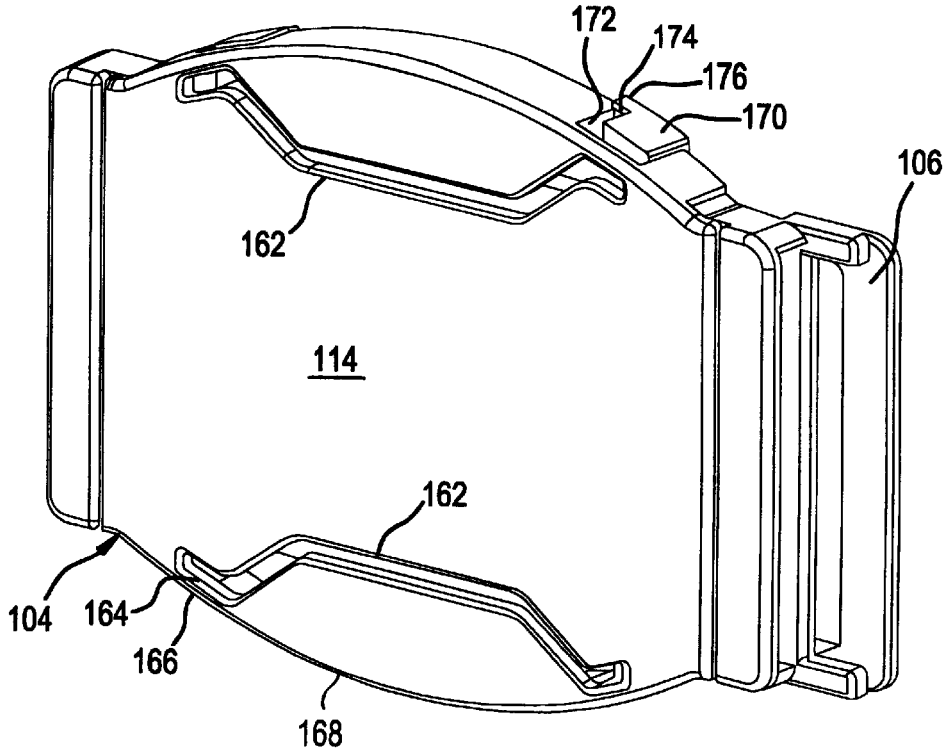
FIG. 22 is a top prospective view of the buckle showing the buckle in open, web-releasing position.
Figure 23:
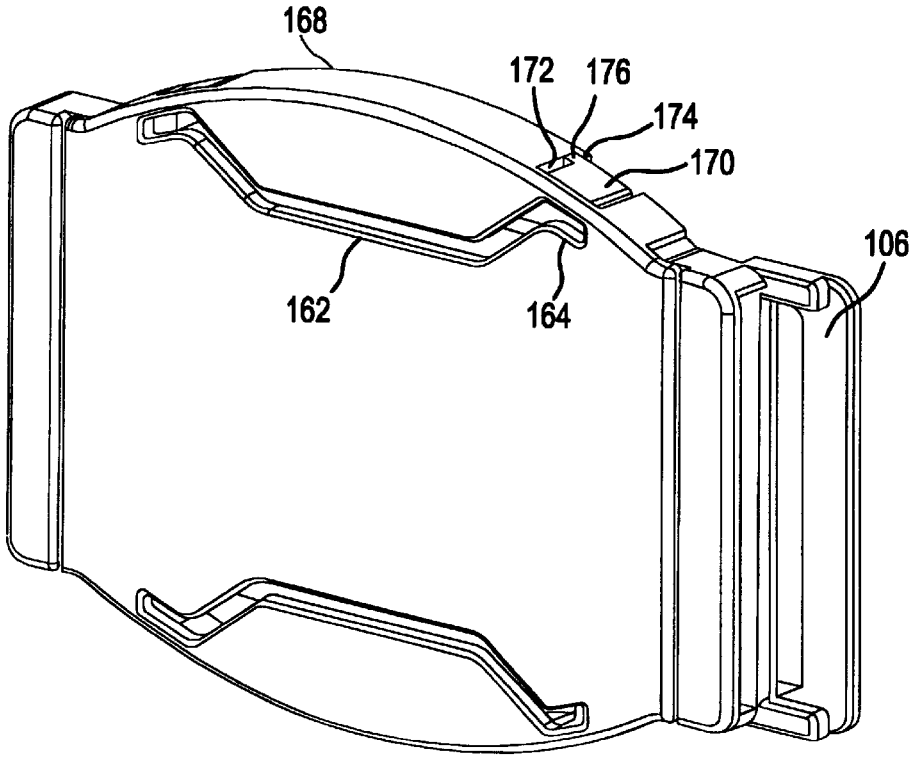
FIG. 23 is a top prospective view of the buckle showing the buckle in closed, web-locking condition.
Figure 24:
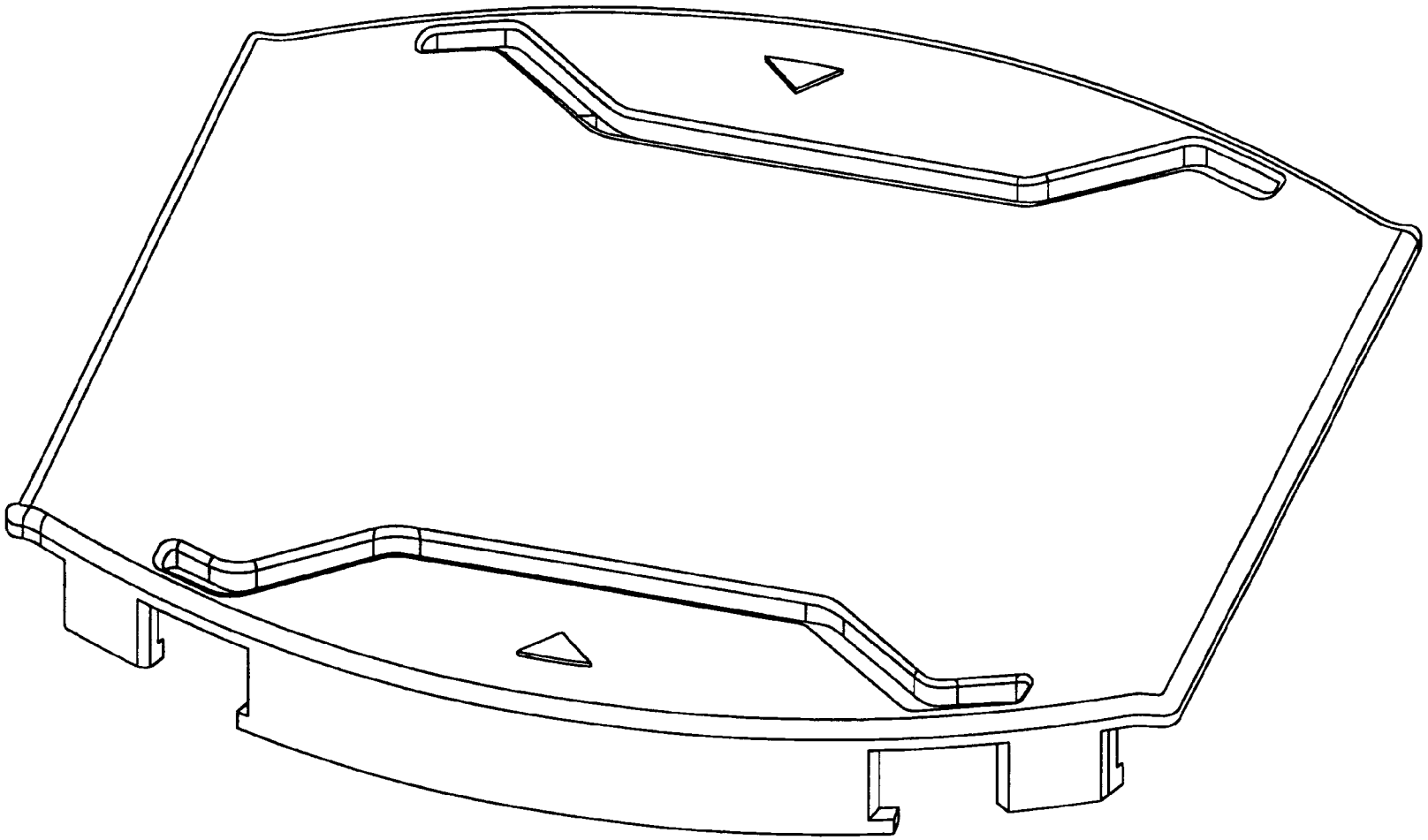
FIG. 24 is a schematic representation showing the inward pressing movement on the outer buckle cover to change positions.

As shown in FIG. 22, the upper surface 114 of the outer member 104 is formed with opening 162. Outer portions 164 of the openings form thin flexible members 166 in the outer walls 168 of the outer members 104. Position-locking tabs 170 are extended from the inner member and slide within recesses 172 and outer walls 168 of the outer member. The recesses have inward extensions 174 which cooperate with extending lugs 176 on position-locking tabs 170 to hold the inner and outer members in locked condition or in unlocked condition as shown in FIG. 22.

Figures 25, 26, 27:
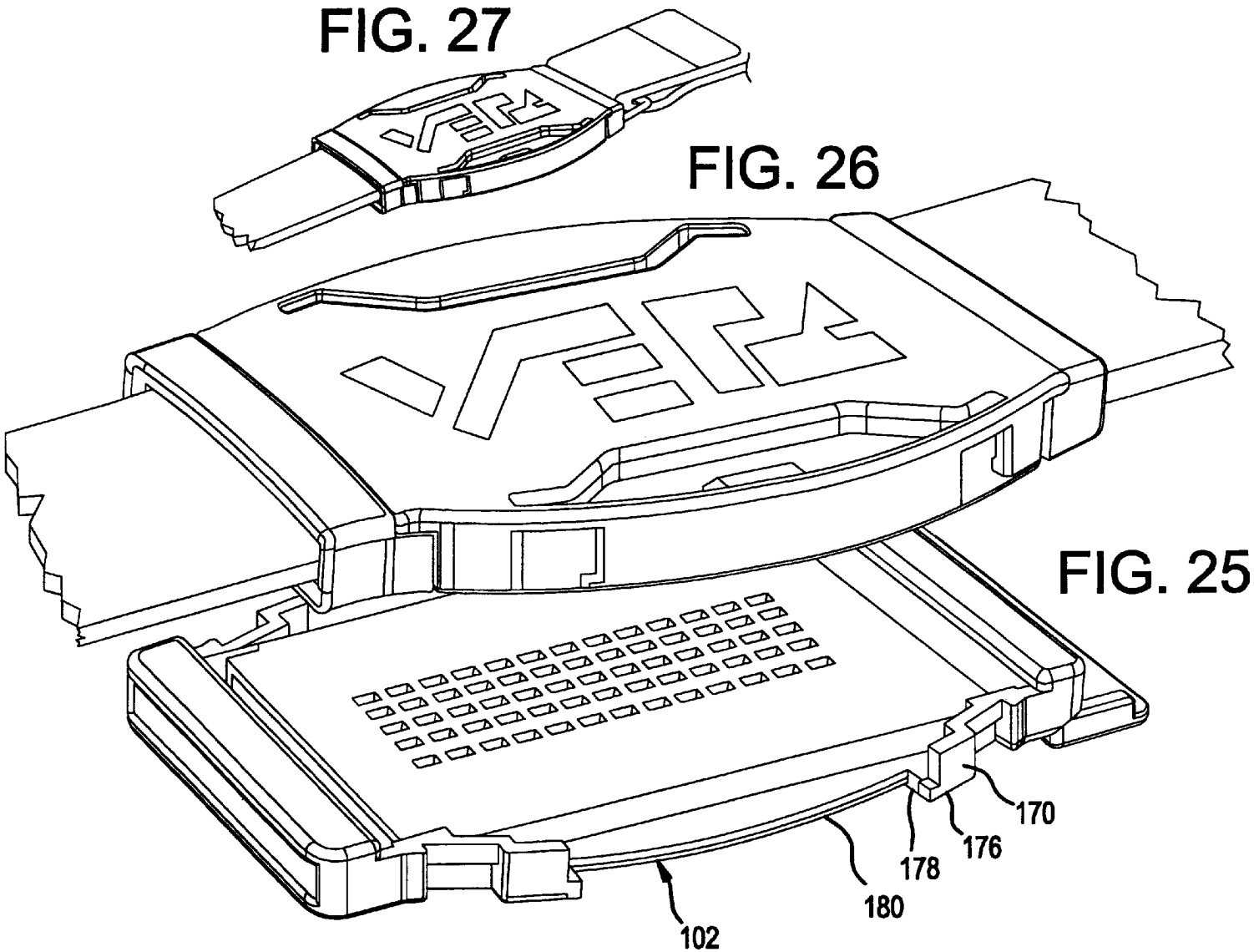
FIG. 25 is a prospective view of the inner portion of the buckle.
FIG. 26 is a prospective view of the assembled buckle.
FIG. 27 is an overall view showing the buckle mounted on a web belting.

As shown in FIG. 26, the locking tabs 170 are mounted on outward extensions 178 of the inner member 104. The curved outer walls 180 of the inner member are spaced inward from the curved walls 168 of the outer member so that the entire central portion of the outer wall 168 may be squeezed inward to allow the inward extensions 174 to be positioned inward of the lugs 176 when the cover is moved between belt-locking and belt-releasing positions.

The buckle is made of two pieces. It can be different sizes and has multiple applications. The buckle works with laminated strap-webbing or open weave strap-webbing, and allows the webbing to pass through the buckle. It allows the user to engage or disengage the locking means. When the engaging means are engaged, they can prevent webbing from sliding or be configured to allow belting to move in only one direction. The buckle is moldable in multiple materials and is low cost.

While the invention has been described with reference to specific embodiments, modifications and variations of the invention may be constructed without departing from the scope of the invention.

What is claimed is:

1. Web securing apparatus comprising a buckle having an inner member and an outer member, the inner and outer members being movable with respect to each other into web-locking and web-releasing conditions, prongs extending inward from the outer member, openings in the inner member slidably receiving the prongs, guides in the buckle for passing a web through the buckle for engaging the prongs in the web in the web-locking condition and for spacing the prongs from the web in the web-releasing condition.

2. The apparatus of claim 1, further comprising a web having a fixed end attached to the inner member and where the guides are attached to the inner member for passing the web through the inner member adjacent the openings on a side of the inner member opposite the outer member.

3. The apparatus of claim 1, wherein the opening have internal slopes for guiding the prongs along the slopes and extending the prongs through the openings at angles.

4. The apparatus of claim 3, wherein the prongs extend through the openings and extend from the openings at uniform angles.

5. The apparatus of claim 4, wherein tips of the prongs engage the web and wherein inward motion of the web lifts the prong tips and wherein attempted reverse motion of the web embeds the prong tips in the web.

6. The apparatus of claim 4, wherein the slopes are oriented in cross directions for configuring the prongs in cross directions as the buckle members are moved from the web-releasing condition into the web-locking condition for extending the prongs from the openings in the inner member in crossed directions through the web.

7. The apparatus of claim 1, further comprising locking tabs on one of the members and cooperating recesses in one other member for receiving the locking tabs, first detent in the recesses and complementary second detent on the locking tabs for cooperating and holding the detent and the locking tabs in one of the web-locking and web-releasing conditions.

8. The apparatus of claim 1 wherein the outer member has outward extending flexible sides which extend outward beyond the inner member, guide lugs on the inner member and recesses in outer walls of the outer member for receiving the guide lugs for guiding respective movement of the outer member and the inner member between the web-locking and web-releasing conditions.

9. The apparatus of claim 8 further comprising first detents connected to the outer walls of the outer member and second complementary detent connected to the inner member for engaging the detents in the outer member and holding the outer member and inner member in respective web-locking and web-releasing conditions.

10. The apparatus of claim 1, wherein the inner member has end walls which extend outward and wherein the outer member has end walls which are positioned within the end portions of the inner member for guiding the outer member with respect to the inner member during movements of the outer member and inner member between web-locking and web-releasing conditions.

11. The apparatus of claim 1, wherein the outer member has flexible side walls which extend laterally beyond respective side walls of the inner member and further comprising springs connected to lateral portions of the inner member for pushing the outer member away from the inner member.

12. The apparatus of claim 11, wherein the springs comprise cantilevered leaves having bases connected to laterally outward extensions of the inner member and having free ends extended upward toward the outer member.

13. The apparatus of claim 11 further comprising ramps connected to laterally outward extensions of the inner member and followers connected to the flexible outer walls of the outer member for contacting the ramps and lifting the outer member away from the inner member upon inward pressure on the flexible outer walls of the outer member.

14. The apparatus of claim 13, wherein the inner member has curved, rigid lateral walls and wherein the outer member has curved flexible lateral walls spaced from and overlying the curved rigid lateral walls of the inner member.

15. A method of securing a webbing strap comprising moving an outer member toward an inner member, extending prong teeth from the outer member through openings in the inner member and engaging the prong teeth in the web and holding the outer member in web-locking condition on the inner member, further comprising angling the prong teeth on sloped walls within the openings in the inner member and extending the teeth from the openings in angled position and engaging the web.

16. The method of claim 15, wherein the prong teeth are angled in parallel directions.

17. The method of claim 15, wherein the teeth are angled in opposite, crossing directions for locking the web in the buckle.

18. A method of securing a webbing strap comprising moving an outer member toward an inner member, extending prong teeth from the outer member through openings in the inner member and engaging the prong teeth in the web and holding the outer member in web-locking condition on the inner member, further comprising squeezing curved lateral walls of the outer member inward and moving the outer member away from the inner member with springs and ramps on lateral sides of the inner member.

19. A method of securing a webbing strap comprising moving an outer member toward an inner member, extending prong teeth from the outer member through openings in the inner member and engaging the prong teeth in the web and holding the outer member in web-locking condition on the inner member, further comprising guiding the outer member over the inner member by contacting longitudinal end walls of the outer member with outward extensions on longitudinal ends of the inner member.

20. The method of claim 19 further comprising interconnecting deep detents in the receivers with detents in the lugs and holding the outer member respectively in web-locking condition and in web-releasing condition with the interengaged detents.

21. A method of securing a webbing strap comprising moving an outer member toward an inner member, extending prong teeth from the outer member through openings in the inner member and engaging the prong teeth in the web and holding the outer member in web-locking condition on the inner member, further comprising extending lugs laterally from overlapping walls in one of the members toward the other and receiving the lugs in recesses formed in complimentary lateral walls of the other member.

22. A method of securing a webbing strap comprising moving an outer member toward an inner member, extending prong teeth from the outer member through openings in the inner member and engaging the prong teeth in the web and holding the outer member in web-locking condition on the inner member, further comprising providing flexible outer walls on the outer member for overlying outer walls of the inner member and urging the outer member upward with springs attached to the outer walls of the inner member.

23. The apparatus of claim 22, further comprising providing ramps on outer walls of the inner member and followers on inner surfaces of the lateral walls of the outer member and contacting the ramps with the followers upon squeezing the flexible outer walls of the outer member inward and urging the outer member away from the inner member with the ramps.

* * * * *